US007677556B2

(12) United States Patent
Murayama et al.

(10) Patent No.: US 7,677,556 B2
(45) Date of Patent: Mar. 16, 2010

(54) SHEET FEEDING APPARATUS AND IMAGE FORMING APPARATUS

(75) Inventors: Shigeo Murayama, Susono (JP); Kenichi Nakao, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 11/677,152

(22) Filed: Feb. 21, 2007

(65) Prior Publication Data

US 2007/0222143 A1 Sep. 27, 2007

(30) Foreign Application Priority Data

Mar. 24, 2006 (JP) ..... 2006-084115

(51) Int. Cl.
*B65H 1/00* (2006.01)

(52) U.S. Cl. ..... 271/162; 271/117

(58) Field of Classification Search ..... 271/18, 271/162, 145, 117, 9.01, 9.05; 347/104
See application file for complete search history.

(56) References Cited

U.S. PATENT DOCUMENTS 7,100,915 B2 * 9/2006 Lee et al. ..... 271/147

FOREIGN PATENT DOCUMENTS

JP 11-171360 6/1999
JP 2003-182874 * 7/2003

* cited by examiner

*Primary Examiner*—Patrick H Mackey
*Assistant Examiner*—Thomas A Morrison
(74) *Attorney, Agent, or Firm*—Fitzpatrick, Cella, Harper & Scinto

(57) ABSTRACT

A holding member is rotatably axially supported to the apparatus main body, holds the sheet feeding unit to a rotational edge, and moves the sheet feeding unit to one of a sheet feeding position and a standby position and a gear train. By transferring the rotation of the opening/closing operation of the feed tray to the holding member through the gear train so that the sheet feeding unit is moved along with the opening/closing operation of the feed tray.

10 Claims, 8 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus and, more particularly, to a construction of a sheet feeding apparatus for feeding sheets stacked on a feed tray closably provided for an image forming apparatus main body.

2. Description of the Related Art

Hitherto, an image forming apparatus such as printer, or copying apparatus has a sheet feeding apparatus for feeding a sheet to an image forming unit. As such a sheet feeding apparatus, for example, there is a manual feeding apparatus in which sheets are stacked on a manual feed tray closably provided for the image forming apparatus main body and fed by a manual feeding roller. Since sheets of different sizes and types can be set onto the manual feed tray and fed therefrom, such a manual type sheet feeding apparatus is also called a multi-feeding apparatus.

In the manual type sheet feeding apparatus, if the manual feeding roller is fixedly arranged, there is a case where a part of the sheet feeding apparatus is projected from the side surface of the image forming apparatus main body (hereinbelow, referred to as an apparatus main body) and the image forming apparatus increases in size. Therefore, there is an apparatus constructed in such a manner that the manual feeding roller is moved to a sheet feeding position adapted to feed the sheet in association with the opening of the manual feed tray and allowed to refuge into the apparatus main body in association with the closure of the manual feed tray, thereby preventing the sheet feeding apparatus from being projected from the side surface of the apparatus main body. For example, the sheet feeding apparatus of such a construction has been disclosed in Japanese Patent Application Laid-Open No. H11-171360.

FIG. 8 illustrates a structure of the conventional sheet feeding apparatus with such a construction. A manual feeding roller 1 is attached to a feeding roller axis 2 to which a driving force is transferred from a driving source (not shown) and which rotates the manual feeding roller 1. The feeding roller axis 2 is rotatably attached to a feeding arm 3 supported to a feeding arm axis 5 so that it can swing freely.

One end of each of hinge members 8 is rotatably attached to a main body frame 13. The other ends of the hinge members 8 are attached to a rotational front edge side of a manual feed tray 7. A pin 8*a* is projected on a rotational front edge side of each of the hinge members 8. The pins 8*a* have slidably been inserted into guiding long holes 12 formed on a rotational front edge side of a feeding cover 10 rotatably provided for the main body frame 13.

The feeding arm 3 and the feeding cover 10 are coupled through a link arm 16. Thus, the feeding arm 3 swings in an interlocking relational manner with the opening and closure of the manual feed tray 7 and the feeding cover 10.

With such a construction, when the feeding cover 10 is opened, the manual feed tray 7 is integratedly rotated in the direction in which the manual feed tray 7 is released from the main body frame 13. Thus, the manual feeding roller 1 swings to the sheet feeding position (state illustrated in FIG. 8). When the feeding cover 10 is closed, the manual feed tray 7 is integratedly rotated toward the main body frame 13 side. Thus, the manual feeding roller 1 swings to the refuge position where it is enclosed between the main body frame 13 and the manual feed tray 7. With such a construction, the sheet feeding apparatus can be set into the apparatus main body without enlarging the apparatus main body size.

According to the conventional manual type sheet feeding apparatus, the sheet feeding position of the manual feeding roller 1 is unconditionally determined by positional precision and parts precision of at least the feeding arm 3, link arm 16, and feeding cover 10.

Particularly, since the link arm 16 has an elongated plate shape or a thin flat plate shape, its rigidity is low. There are also an influence by the positional precision and gravity of parts, and a bending deformation due to a feeding load. Therefore, if such a link arm 16 is used, it is difficult to strictly guarantee the sheet feeding position of the manual feeding roller 1.

When the sheet feeding position cannot be strictly guaranteed as mentioned above, a feeding pressure of the manual feeding roller 1 is not assured for the sheets supported to the manual feed tray 7 and there is a possibility that the sheet cannot be certainly fed. There is also a possibility that the manual feeding roller 1 is inclined and come into offset contact with the stacked sheets, an oblique motion of the sheets occurs, and defective printing precision occurs.

Further, in the case of coupling the feeding arm 3 and the feeding cover 10 by using the link arm 16, the link arm 16 has such a layout that it is projected to the sheet stacking portion side of the manual feed tray 7. There is, consequently, a risk that when the user stacks the sheets onto the manual feed tray, the link arm 16 becomes an obstacle to the operation and makes the user's operation annoying.

If the manual feed tray 7 as a pressing member for pressing the sheets to the manual feeding roller 1 has been provided, a hole, or a notch through which the link arm 16 penetrates needs to be formed in the manual feed tray 7. Further, when the hole, or notch is formed in the pressing member as mentioned above, it is necessary to form a through hole including a moving locus of the link arm 16 which moves in an interlocking relational manner with the opening/closing operation of the manual feed tray 7.

However, if such a through hole is formed, the part rigidity of the manual feed tray 7 as a pressing member is weakened. Thus, the necessary feeding pressure cannot be assured and there is a possibility that the sheet cannot be certainly fed.

SUMMARY OF THE INVENTION

The invention is made in consideration of such circumstances and it is an object of the invention to provide a sheet feeding apparatus and an image forming apparatus which can certainly feed sheets stacked on a feed tray.

According to the invention, there is provided a sheet feeding apparatus having a feed tray closably provided for an apparatus main body and a sheet feeding unit which moves to one of a sheet feeding position and a standby position in association with opening/closure of the feed tray, comprising: a holding member which is rotatably axially supported to the apparatus main body, holds the sheet feeding unit, and moves the sheet feeding unit to one of the sheet feeding position and the standby position; and a gear train which transfers a rotation of the opening/closing operation of the feed tray to the holding member.

Further features of the present invention will become apparent from the following description of exemplary embodiments with reference to the attached drawings.

DESCRIPTION OF THE EMBODIMENTS

Figure 1:
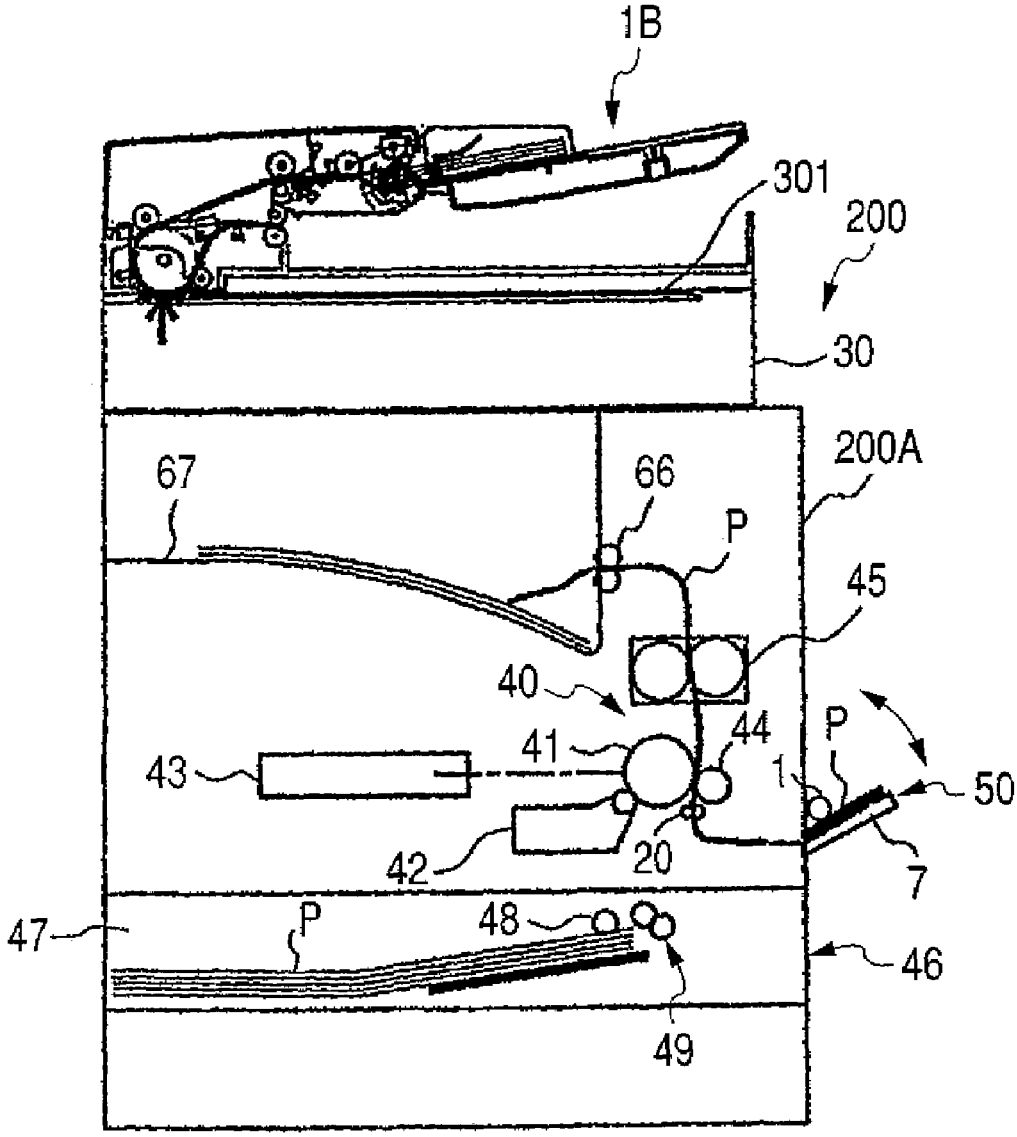
FIG. 1 is a diagram illustrating a schematic construction of a copying apparatus as an example of an image forming apparatus having a sheet feeding apparatus according to the first embodiment of the invention.

FIG. 1 is a cross sectional view when seen from the front side in order to illustrate a schematic construction of a copying apparatus as an example of an image forming apparatus having a sheet feeding apparatus according to the first embodiment of the invention.

In FIG. 1, a copying apparatus 200 has a copying apparatus main body (hereinbelow, referred to as an apparatus main body) 200A. A scanner unit 30 as an image reading unit is provided on the apparatus main body 200A. An image forming unit 40 for forming an image onto a sheet P is arranged in a center portion of the apparatus main body 200A. Further, a cassette feeding apparatus 46 and a sheet feeding apparatus 50 as an example of the sheet feeding apparatus for feeding the sheet P to the image forming unit 40 are arranged under the apparatus main body 200A, respectively.

The image forming unit 40 has an electrophotographic photosensitive drum (hereinafter, referred to as a photosensitive drum) 41 and a developing device 42. When a laser beam emitted from a laser scanner 43 is scanned onto the surface of the photosensitive drum 41, a latent image is formed on the surface of the photosensitive drum. Further, by developing the latent image by the developing device 42, a toner image is formed on the photosensitive drum surface. After that, when the sheet is conveyed to a transfer unit including the photosensitive drum 41 and a transfer charging device 44, the toner image formed on the photosensitive drum 41 is transferred onto the sheet.

The cassette feeding apparatus 46 arranged under the apparatus main body 200A is used to supply the sheet P to the image forming unit 40. The cassette feeding apparatus 46 has: a cassette 47 in which the sheets are enclosed; a feeding roller 48 for feeding the sheets P enclosed in the cassette 47; and a retard roller pair 49 for separating the sheets. When the image is formed, the feeding roller 48 and the retard roller pair 49 rotate according to the image forming operation and separate and feed the sheets P one by one from the cassette 47.

The sheet feeding apparatus 50 has: the manual feed tray 7 as a feed tray closably provided on the side surface of the apparatus main body 200A; and the manual feeding roller 1 as a sheet feeding unit for feeding the sheets P supported to the manual feed tray 7. Upon image creation, the manual feeding roller 1 rotates according to the image forming operation and feeds the sheets P one by one from the manual feed tray 7.

The scanner unit 30 is arranged on the apparatus main body 200A. The scanner unit 30 is used to read an image of an original document which has automatically been fed from an automatic document feeder (hereinafter, abbreviated to ADF) 1B onto a copyboard glass 301. After the image of the original is read, image information is converted into an electric image signal. The image information converted into the electric image signal is input to the laser scanner 43 of the image forming unit 40 mentioned above.

The image forming operation of the copying apparatus 200 constructed as mentioned above will now be described.

First, when the image information of the original is read by the scanner unit 30, the image information is image-processed, thereafter, converted into an electric signal, and transmitted to the laser scanner 43 in the image forming unit 40. The copying apparatus 200 also has a printer function and there is also a case where image information is input from an external apparatus such as a personal computer (not shown).

In the image forming unit 40, the surface of the photosensitive drum 41 is scanned by the laser beam emitted from the laser scanner 43 and corresponding to the image information, thereby forming a latent image onto the photosensitive drum. After that, the latent image is developed by the developing device 42. Thus, the toner image is formed onto the surface of the photosensitive drum 41.

In the case of feeding the sheets P from the manual type sheet feeding apparatus 50 to the image forming unit 40 in parallel with the above operation, the sheets P are fed one by one from the manual feed tray 7 by the manual feeding roller 1. In the case of feeding the sheets P from the cassette feeding apparatus 46, the sheets P enclosed in the cassette are separated and fed one by one by the feeding roller 48 and the retard roller pair 49.

The sheet P fed from one of the sheet feeding apparatus 50 and the cassette feeding apparatus 46 is conveyed to a registration roller 20. In this instance, the registration roller 20 has been stopped. Therefore, a sheet front edge is made to collide with a nip portion of the stopped registration roller 20, thereby correcting the oblique motion of the sheet P. The sheet P enters a standby mode at this stop position.

After that, the registration roller 20 rotates. The standby sheet P is fed to the transfer unit including the photosensitive drum 41 and the transfer charging device 44 at the matched timing. When the sheet P passes through the nip portion, the toner image on the photosensitive drum is transferred onto the sheet P.

The sheet onto which the toner image has been transferred in this manner is conveyed to a fixing device 45. When the sheet P passes through the fixing device 45, it is heated and pressed. Thus, the toner image is fixed onto the sheet surface. After that, the sheet P onto which the toner image has been fixed as mentioned above is ejected onto a discharge tray 67 by a sheet discharge roller 66.

Figure 2:
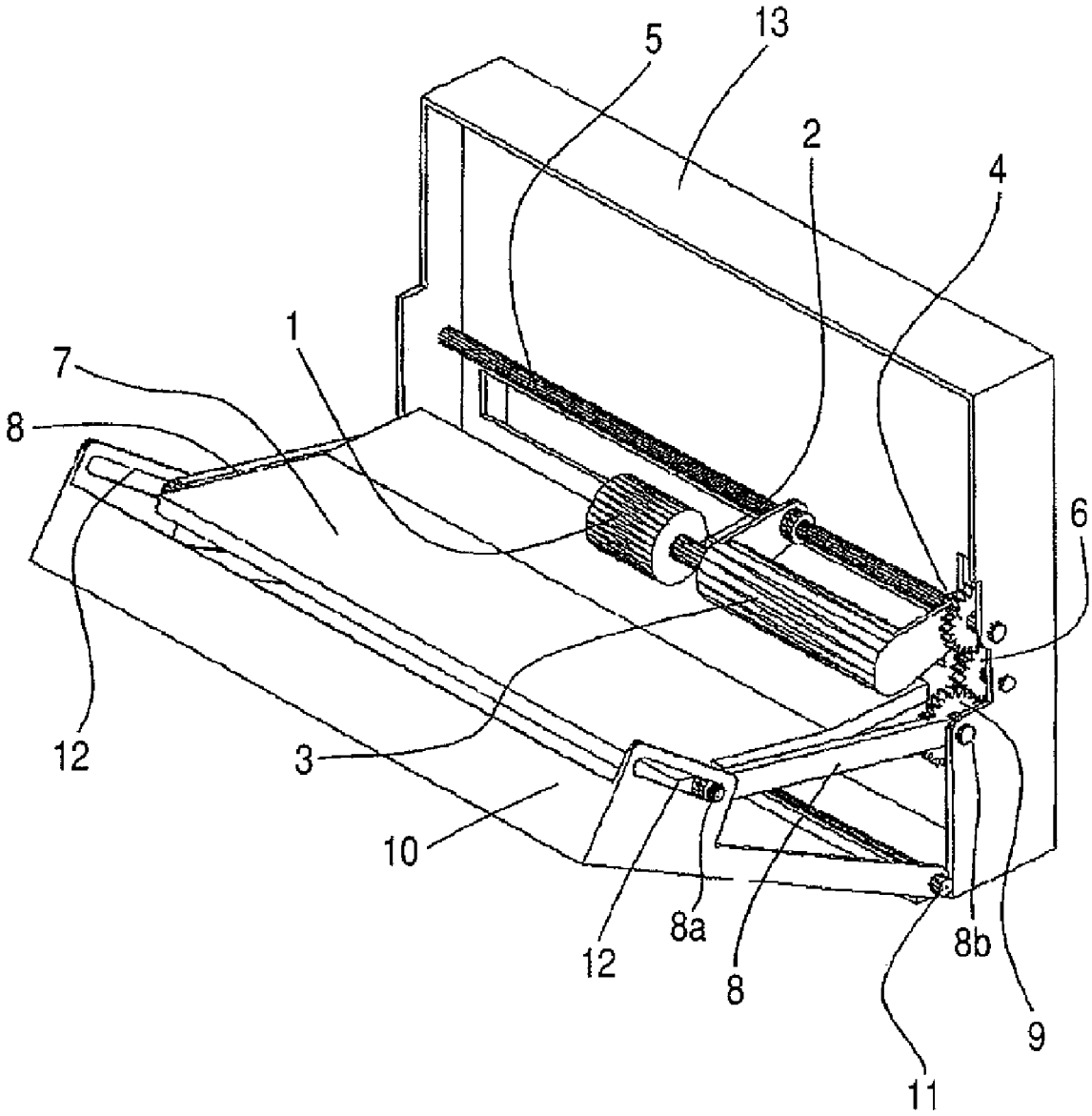
FIG. 2 is a perspective view for describing a construction of the sheet feeding apparatus.
Figure 8:
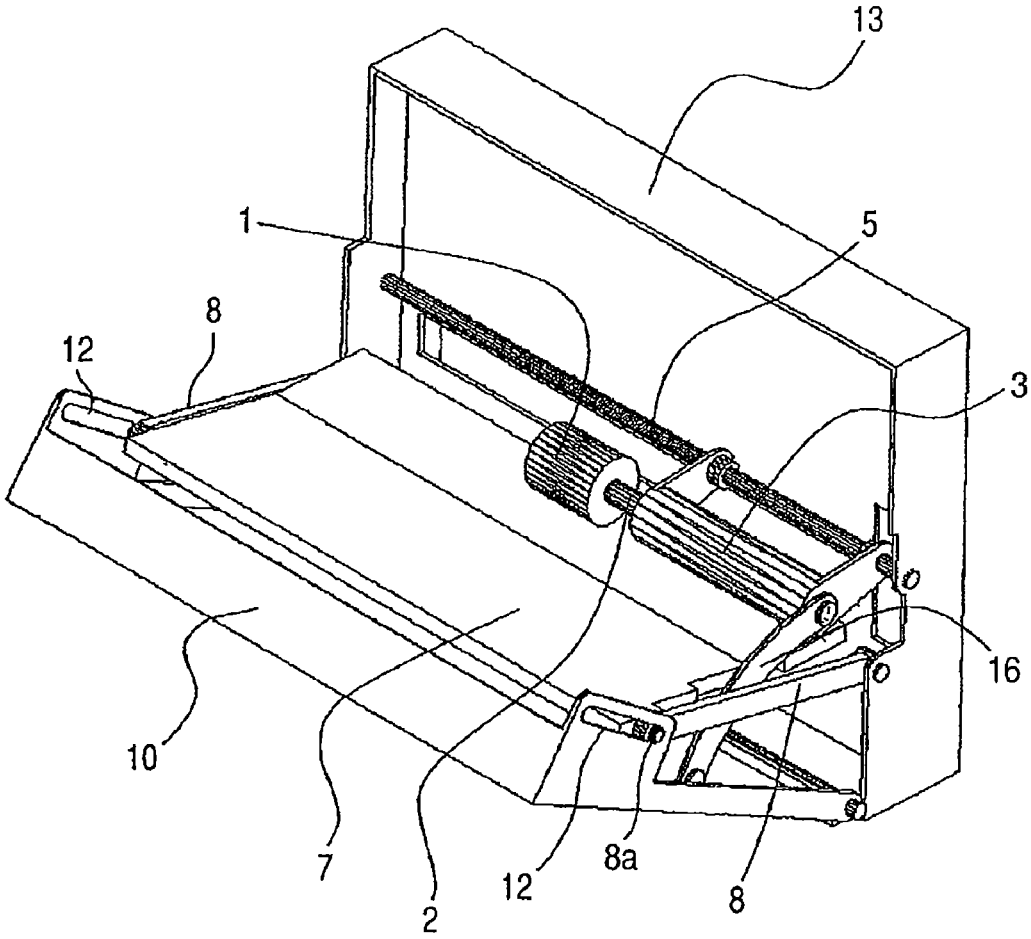
FIG. 8 PRIOR ART
FIG. 8 is a perspective view for describing a construction of a conventional sheet feeding apparatus.

FIG. 2 is a perspective view for describing a construction of the sheet feeding apparatus 50. In FIG. 2, the same or corresponding portions as those in FIG. 8 are designated by the same reference numerals.

In the sheet feeding apparatus 50, the manual feeding roller 1 is attached to the feeding roller axis 2. The feeding roller axis 2 is rotatably held by the feeding arm 3 as a holding member supported to the feeding arm axis 5 so that it can swing freely. The feeding arm axis 5 is rotatably coupled with a driving source (not shown). The feeding arm axis 5 and the feeding roller axis 2 are constructed so that the rotation is transferred to them through a driving transfer gear train (not shown). The rotation of the driving source is transferred to the manual feeding roller 1 through the feeding arm axis 5, driving transfer gear train, and feeding roller axis 2, thereby rotating the roller 1.

The manual feed tray 7 is urged in the direction of the manual feeding roller by an urging member such as a coil spring (not shown). The manual feed tray 7 is rotatably (closably) held by the hinge members 8 which have rotatably and axially supported to the right and left side walls of the main body frame 13 constructing the apparatus main body 200A. The pins 8*a* are formed at rotational edges of the hinge members 8 so as to be projected therefrom. The pins 8*a* are slidably inserted into the guiding long holes 12 formed at rotational edges of the feeding cover 10 rotatably provided for the main body frame 13.

A feeding arm gear 4 as a second gear is integrated arranged at a side edge of the feeding arm 3. The feeding arm gear 4 is rotatably and coaxially attached to the feeding arm axis 5. The hinge member 8 is rotatably and axially supported by one of rotary axes 8*b*. A manual feed tray gear 9 as a first gear is integratedly and coaxially attached to the rotary axis 8*b*. The gear 9 is rotated in association with the opening/closure of the manual feed tray 7, as will be described hereinafter.

An interlocking gear 6 attached to the main body frame 13 is in engagement with the manual feed tray gear 9 and the feeding arm gear 4. Gear phases of the interlocking gear 6, manual feed tray gear 9, and feeding arm gear 4 are set in such a manner that a backlash in the circumferential direction of each gear is equal to 0 in the case where the manual feeding roller 1 collides with the apparatus main body side in the direction toward the refuge direction through the sheet by an urging force of the manual feed tray 7. The gear train is composed of the feeding arm gear 4, the interlocking gear 6 and manual feed tray gear 9.

The enclosing operation of the sheet feeding apparatus 50 with such a construction will now be described.

Figure 3:
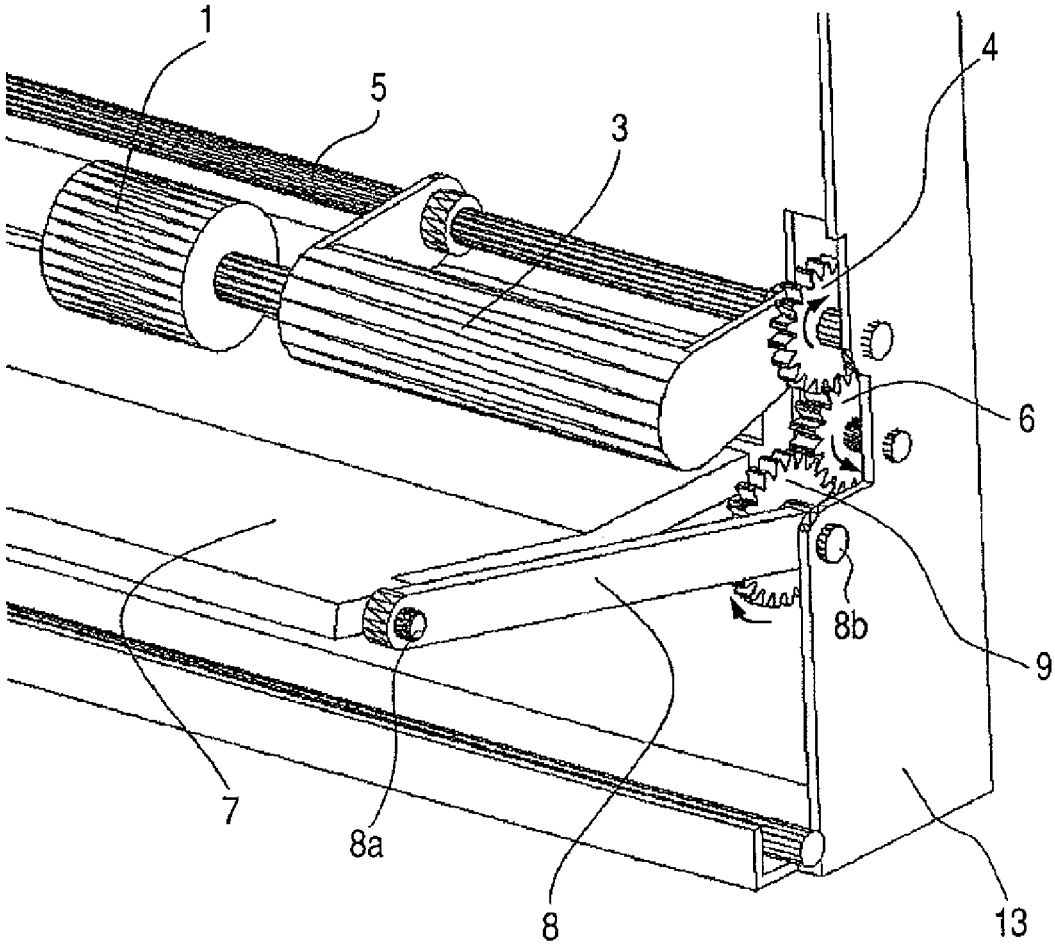
FIG. 3 is a perspective view for describing an opening/closing mechanism of the sheet feeding apparatus.

In the case of enclosing the sheet feeding apparatus 50, the feeding cover 10 is rotated in the closing direction. When the feeding cover 10 is rotated, the manual feed tray 7 rotates toward the main body frame 13 side. In association with it, the hinge member 8 is guided by the long hole 12 of the feeding cover 10 and rotates around the rotary axis 8*b* as a center clockwise as illustrated in FIG. 3. The manual feed tray gear 9 rotates clockwise integratedly with the hinge member 8.

Figure 4:
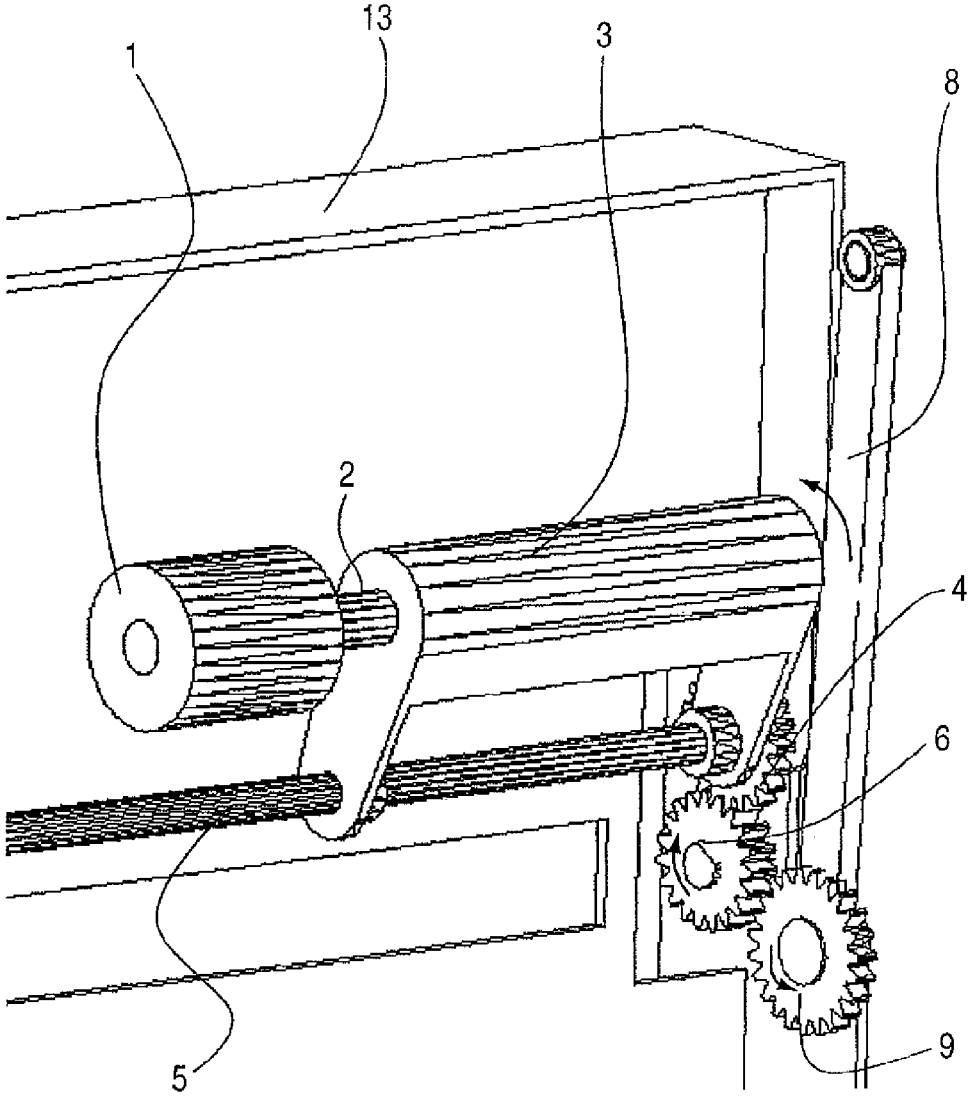
FIG. 4 is a perspective view for describing the closing operation of the sheet feeding apparatus.
Figure 5:
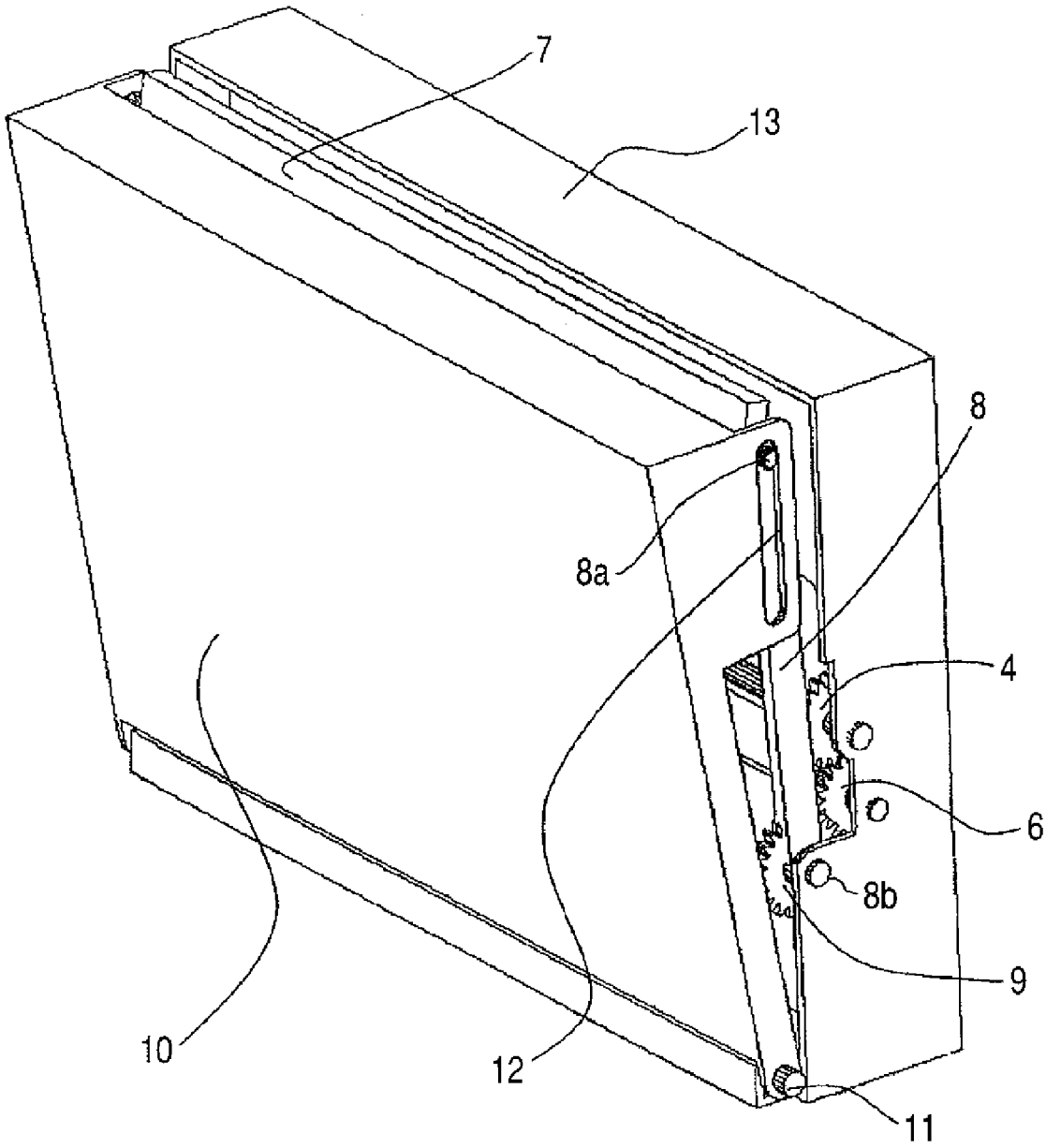
FIG. 5 is a perspective view illustrating a state where the sheet feeding apparatus has been closed.

When the manual feed tray gear 9 rotates clockwise as mentioned above, the interlocking gear 6 which is in engagement with the manual feed tray gear 9 rotates counterclockwise. Thus, the feeding arm gear 4 which is in engagement with the interlocking gear 6 rotates clockwise. Thus, the feeding arm 3 coupled integratedly with the feeding arm gear 4 also rotates clockwise. The manual feeding roller 1 rotates to the refuge position where it is enclosed between the manual feed tray 7 and the main body frame 13 as illustrated in FIGS. 4 and 5.

When using the sheet feeding apparatus 50, the feeding cover 10 is rotated in the opening direction. When the feeding cover 10 is rotated as mentioned above, the manual feed tray 7 rotates in the opening direction. Thus, the hinge member 8 is guided by the long hole 12 of the feeding cover 10 and rotates around the rotary axis 8*b* as a center counterclockwise in the direction as illustrated in FIG. 5. In association with it, the manual feed tray gear 9 rotates counterclockwise integratedly with the hinge member 8.

When the manual feed tray gear 9 rotates counterclockwise in this manner, the interlocking gear 6 which is in engagement with the manual feed tray gear 9 rotates clockwise. In association with it, the feeding arm gear 4 rotates counterclockwise. Thus, the feeding arm 3 coupled integratedly with the feeding arm gear 4 also rotates counterclockwise. Consequently, the manual feeding roller 1 is projected from the main body frame 13 as illustrated in FIG. 3 and moved to the sheet feeding position.

As mentioned above, according to the embodiment, the manual feeding roller 1 can be arranged at the sheet feeding position in an interlocking relational manner with the opening of the manual feed tray 7. The manual feeding roller 1 can be enclosed between the manual feed tray 7 and the main body frame 13 in an interlocking relational manner with the closure of the manual feed tray 7. Thus, the apparatus main body 200A can be miniaturized and space use efficiency can be improved.

When the sheet feeding apparatus 50 with such a construction feeds the sheet in the sheet feeding state illustrated in FIG. 2, if a feeding pressure is applied from the manual feed tray 7 to the manual feeding roller 1, a force for rotating in the refuge direction is applied from the manual feeding roller 1.

In the embodiment, the positioning of the manual feed tray 7 in the open state is performed by three points determined by each of both rotary axes 8*b* of the hinge members 8, a feeding cover axis 11 of the feeding cover 10, and each of inner wall surfaces of the long holes 12 of the feeding cover 10 on the hinge member side.

As mentioned above, in the embodiment, in the sheet feeding state illustrated in FIG. 2, the gear phases are set in such a manner that the backlashes in the circumferential direction at two gear engaging portions of the manual feed tray gear 9, interlocking gear 6, and feeding arm gear 4 are equal to 0. Therefore, the positional precision of the manual feeding roller 1 for the manual feed tray 7 depends only on the precision of those three gears (gear train) 4, 6, and 9. That is, the layout position of the manual feeding roller 1 can be guaranteed only by the gear precision of the three gears 4, 6, and 9.

Therefore, by moving the manual feeding roller 1 to the sheet feeding position by the three gears 4, 6, and 9, the layout position of the manual feeding roller 1 can be guaranteed at high precision. By guaranteeing the layout position of the manual feeding roller 1 at high precision, the feeding performance is improved and the occurrence of the defective feed can be prevented.

As mentioned above, by transferring the rotation of the opening/closing operation of the manual feed tray 7 to the feeding arm 3 through the feeding arm gear 4, manual feed tray gear 9, and interlocking gear 6, the manual feeding roller 1 can be moved in association with the opening/closing operation of the manual feed tray 7. Thus, the manual feeding roller 1 can be certainly moved to the sheet feeding position at high precision and the sheet can be certainly fed.

In other words, by moving the manual feeding roller 1 in an interlocking relational manner with the opening/closing operation of the manual feed tray 7 by using the driving transfer of the three gears 4, 6, and 9, the precision at which the manual feeding roller 1 is arranged at the sheet feeding position can be guaranteed only by the gear precision of the small number of gears.

Since the interlocking of the manual feed tray gear 9 and the feeding arm gear 4 can be driven and transferred only by one interlocking gear 6, the precision of the sheet feeding position of the manual feeding roller 1 can be guaranteed by the minimum number of gears.

Further, since the manual feeding roller 1 can be moved in an interlocking relational manner with the opening/closing operation of the manual feed tray 7 by using the driving transfer of the gears, the operation part such as a conventional link arm (refer to FIG. 8) is unnecessary.

Therefore, the operation part can be arranged in a small space on the manual feed tray which is accessed by the user without exposing the operation part such as a link arm. Thus, even when the user stacks the sheets, since there are no obstacles by which he feels an annoyance, the usability is improved.

Since the link arm is unnecessary, even if the pressing member such as a manual feed tray 7 which applies the feeding pressure to the manual feeding roller 1 exists between the manual feeding roller 1 and the feeding cover 10, the hole, notch, or the like through which the link arm penetrates does not need to be formed in the pressing member.

Therefore, since the rigidity of the pressing member does not deteriorate, a fluctuation of the feeding pressure to the manual feeding roller 1 by the pressing member is small. The stable feeding performance can be obtained. The sheet feeding performance is improved.

The second embodiment of the invention will now be described.

Figure 6:
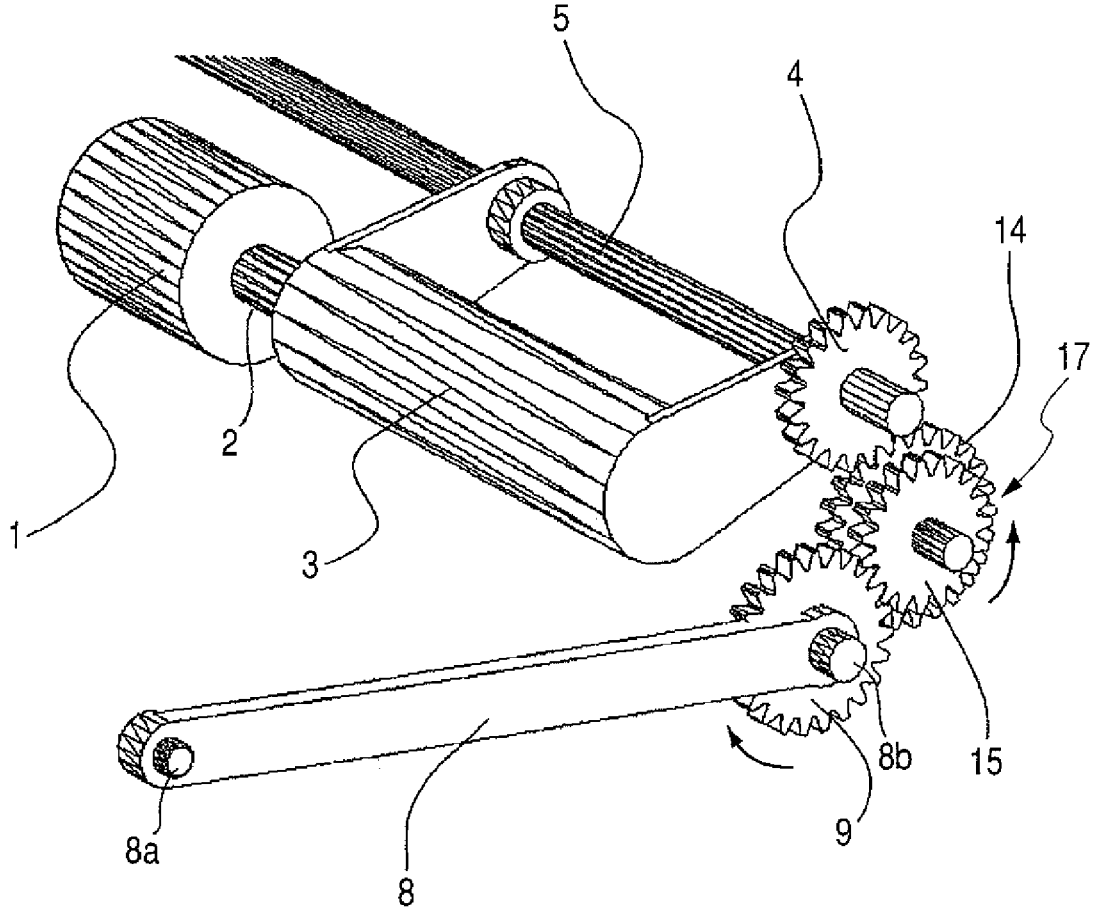
FIG. 6 is a perspective view for describing a construction of a sheet feeding apparatus according to the second embodiment of the invention.

FIG. 6 is a perspective view for describing a construction of a sheet feeding apparatus according to the second embodiment. In FIG. 6, the same or corresponding portions as those in FIG. 2 are designated by the same reference numerals.

In FIG. 6, a multiple gear 17 is an interlocking gear integratedly having: a feeding arm interlocking gear portion 14 as a second gear portion which is come into engagement with the feeding arm gear 4; and a manual feed tray interlocking gear portion 15 as a first gear portion which is come into engagement with the manual feed tray gear 9.

In the embodiment, gear phases of the manual feed tray gear 9, multiple gear 17, and feeding arm gear 4 are set in a manner similar to those in the foregoing first embodiment. That is, the gear phases are set in such a manner that the gear backlashes of (the interlocking gear portions 14 and 15 of) the multiple gear 17 and each of the manual feed tray gear 9 and the feeding arm gear 4 are equal to 0 in the case where the manual feeding roller 1 collides with the apparatus main body side in the direction toward the refuge direction through the sheet by the urging force of the manual feed tray 7.

The enclosing operation of the sheet feeding apparatus 50 with the above construction will now be described.

When enclosing the sheet feeding apparatus 50, the feeding cover 10 is rotated in the closing direction. By rotating the feeding cover 10 in this manner, the manual feed tray 7 rotates toward the main body frame 13 side. In association with it, the hinge member 8 is guided by the long hole 12 of the feeding cover 10 and rotates around the rotary axis 8*b* as a center clockwise as illustrated in FIG. 6. Thus, the manual feed tray gear 9 rotates clockwise integratedly with the hinge member 8.

Figure 7:
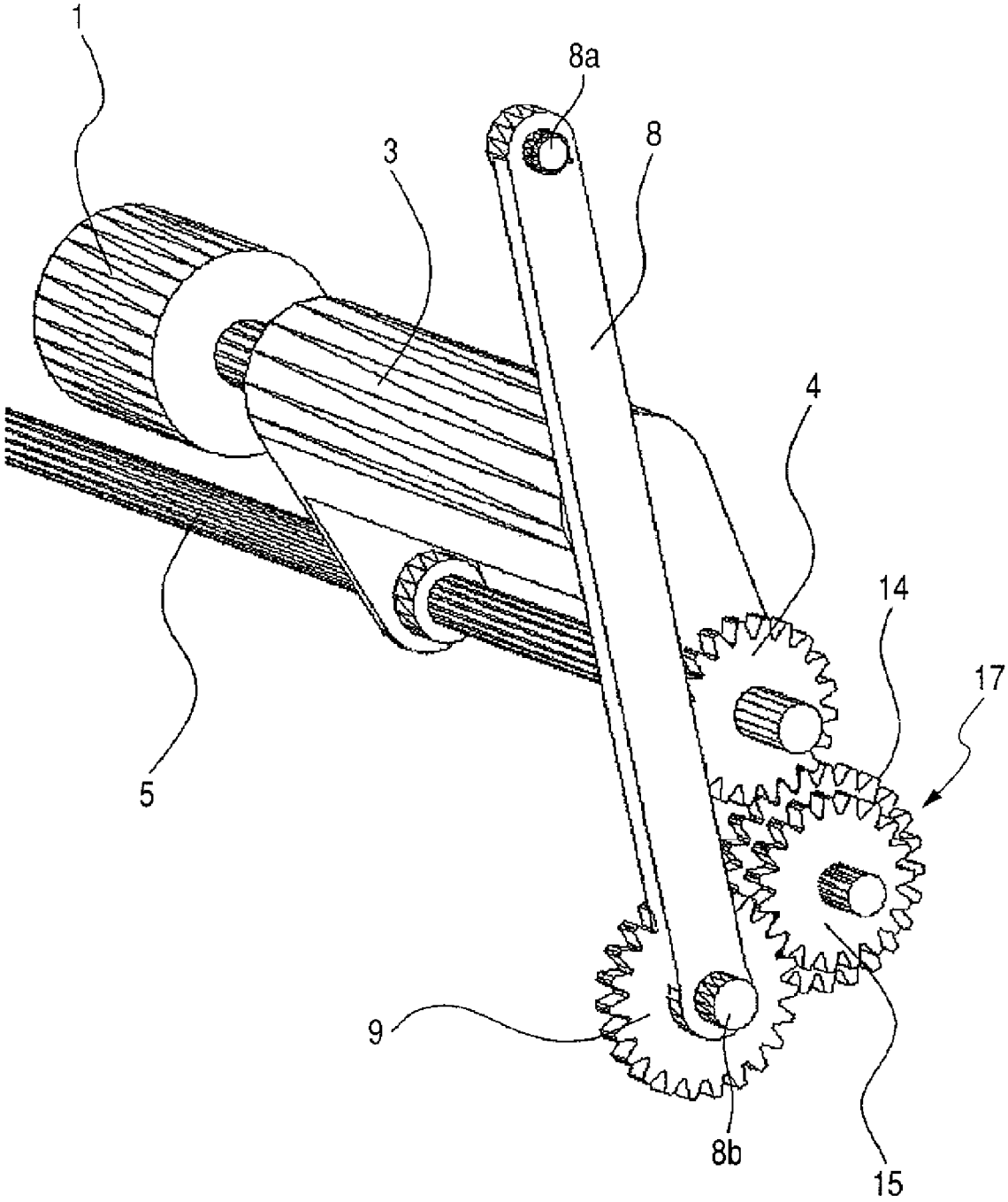
FIG. 7 is a perspective view illustrating a state where the sheet feeding apparatus has been closed.

When the manual feed tray gear 9 rotates clockwise as mentioned above, the manual feed tray interlocking gear portion 15 and feeding arm interlocking gear portion 14 of the multiple gear 17 which is in engagement with the manual feed tray gear 9 rotate counterclockwise. In association with it, the feeding arm gear 4 rotates clockwise. Thus, as illustrated in FIG. 7, the feeding arm 3 integrated with the feeding arm gear 4 also rotates clockwise. The manual feeding roller 1 rotates to the refuge position (refer to FIG. 5) where it is enclosed between the manual feed tray 7 and the main body frame 13.

When using the sheet feeding apparatus 50, the feeding cover 10 is rotated in the opening direction. When the feeding cover 10 rotates as mentioned above, the manual feed tray 7 rotates in the opening direction. In association with it, the hinge member 8 is guided by the long hole 12 of the feeding cover 10 and rotates around the rotary axis 8*b* as a center counterclockwise in the direction as illustrated in FIG. 5. Thus, the manual feed tray gear 9 rotates counterclockwise integratedly with the hinge member 8.

When the manual feed tray gear 9 rotates counterclockwise in this manner, the manual feed tray interlocking gear portion 15 and feeding arm interlocking gear portion 14 of the multiple gear 17 which is in engagement with the manual feed tray gear 9 rotate clockwise and the feeding arm gear 4 rotates counterclockwise. Thus, the feeding arm 3 integrated with the feeding arm gear 4 also rotates counterclockwise. Consequently, the manual feeding roller 1 is projected from the main body frame 13 from the position illustrated in FIG. 7 and moved to the sheet feeding position illustrated in FIG. 6.

In the embodiment, the positioning of the manual feed tray 7 in the open state is performed by the three points determined by each of both rotary axes 8*b* of the hinge members 8, the feeding cover axis 11 of the feeding cover 10, and each of the inner wall surfaces of the long holes 12 of the feeding cover 10 on the hinge member side (refer to FIG. 2).

As mentioned above, in the embodiment, in the sheet feeding state illustrated in FIG. 6, the gear phases are set in such a manner that the backlashes in the circumferential direction at two gear engaging portions of the manual feed tray gear 9, (the two gear portions 14 and 15 of) the multiple gear 17, and the feeding arm gear 4 are equal to 0. Therefore, the positional precision of the manual feeding roller 1 for the manual feed tray 7 depends only on the precision of those three gears 4, 17, and 9. That is, the layout position of the manual feeding roller 1 can be guaranteed only by the gear precision of the three gears 4, 17, and 9.

Therefore, by moving the manual feeding roller 1 to the sheet feeding position by the three gears 4, 17, and 9, the layout position of the manual feeding roller 1 can be guaranteed at high precision. By guaranteeing the layout position of the manual feeding roller 1 at the high precision, the feeding performance is improved and the occurrence of the defective feed can be prevented.

Since the feeding arm gear 4 and the manual feed tray gear 9 are come into engagement with the multiple gear 17 having the two gear portions 14 and 15, for example, by changing the numbers of teeth, modules, and addendum modification coefficients of the gear portions 14 and 15, degrees of freedom regarding setting positions of the two gears 4 and 9 increase. The layout position of the multiple gear 17 can be also adjusted by changing the numbers of teeth and addendum modification coefficients of the feeding arm gear 4 and the manual feed tray gear 9.

The axial center of the multiple gear 17 can be moved to an arbitrary position by adjusting the setting positions, the numbers of teeth, the modules, and the addendum modification coefficients of the feeding arm gear 4 and the manual feed tray gear 9 as mentioned above. That is, by constructing in such a manner that the feeding arm interlocking gear portion 14 and the manual feed tray interlocking gear portion 15 are integratedly and coaxially rotated, the layout, the numbers of teeth, the modules, and the addendum modification coefficients of the manual feed tray gear 9 and the feeding arm gear 4 can be adjusted. The axial center position of the multiple gear 17 can be also finely adjusted.

Thus, when it is difficult to arrange the gears or it is intended to use the gear axis in common with another axis, by adjusting the foregoing specifications, the axial center of the multiple gear 17 can be moved to an arbitrary position. Thus, the space use efficiency is improved, and the low costs and miniaturization of the apparatus main body 200A can be realized.

In the embodiment, the feeding arm interlocking gear portion 14 and the manual feed tray interlocking gear portion 15 are constructed as a multiple gear 17 so as to integratedly rotate the feeding arm interlocking gear portion 14 and the manual feed tray interlocking gear portion 15.

However, the invention is not limited to such a construction. The feeding arm interlocking gear portion 14 and the manual feed tray interlocking gear portion 15 may be replaced by different members such as feeding arm interlocking gear member (second gear member) having the feeding arm interlocking gear portion 14 and manual feed tray interlocking gear member (first gear member) having the manual feed tray interlocking gear portion 15. An effect similar to that mentioned above can be also obtained by constructing in such a manner that by coaxially combining those members, they are integratedly rotated.

Although the manual feed tray 7 is rotated around the main body frame 13 as a rotational center through the hinge member 8 in the above description, the invention is not limited to such a construction. For example, the manual feed tray itself can be directly rotatably attached to the main body frame 13 and, at the same time, a manual feed tray gear may be provided for the rotary axis of the manual feed tray gear. Further, the manual feed tray gear can be also provided for the rotational center of the feeding cover 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2006-084115 filed on Mar. 24, 2006, which is hereby incorporated by reference herein.

What is claimed is:

1. A sheet feeding apparatus having a feed tray closably provided for an apparatus main body and a sheet feeding roller which moves to one of a sheet feeding position which is projected from a side surface of the apparatus main body adapted to feed the sheet and a standby position which is inside of the apparatus main body in association with opening/closure of the feed tray, the sheet feeding apparatus comprising:

a feeding arm which is rotatably axially supported to the apparatus main body, and which feeding arm holds the sheet feeding roller;

a hinge member rotatably supported on the apparatus main body, and which hinge member holds the feed tray; and a gear train which transfers a rotation of the opening/closing operation of the feed tray to the feeding arm, the gear train including a first gear which rotates in an interlocking relational manner with the opening/closure of the feed tray, a second gear which is integrally arranged at the feeding arm, and an interlocking gear which comes into engagement with each of the first gear and the second gear, wherein the gear train transfers the rotation to the feeding arm from the feeding tray so as to move the sheet feeding roller to the sheet feeding position in association with opening of the feed tray and to move the sheet feeding roller to the standby position in association with closure of the feed tray.

2. An apparatus according to claim 1, wherein said interlocking gear is one gear which comes into engagement with both of the first gear and the second gear.

3. An apparatus according to claim 1, wherein the interlocking gear is a multiple gear having a first gear portion which comes into engagement with the first gear and a second gear portion which comes into engagement with the second gear.

4. An apparatus according to claim 1, wherein the interlocking gear is a gear constructed in such a manner that a first gear member having a first gear portion which comes into engagement with the first gear and a second gear member having a second gear portion which comes into engagement with the second gear are coaxially provided and the first gear member and the second gear member rotate integrally.

5. An apparatus according to claim 1, wherein the first gear is attached to the rotary axis of the hinge member in association with the opening/closure of the feed tray.

6. An image forming apparatus having a feed tray closably provided for an apparatus main body, a sheet feeding roller which moves to one of a sheet feeding position which is projected from a side surface of the apparatus main body adapted to feed the sheet and a standby position which is inside of the apparatus main body in association with opening/closure of the feed tray, and an image forming unit which forms an image onto a sheet fed by the sheet feeding roller, comprising:

a feeding arm which is rotatably axially supported to the apparatus main body, and which holds the sheet feeding roller; and a hinge member rotatably supported on the apparatus main body, and which hinge member holds the feeding tray; and a gear train which transfers a rotation of the opening/closing operation of the feed tray to the feeding arm, the gear train including a first gear which rotates in an interlocking relational manner with the opening/closure of the feed tray, a second gear which is integrally arranged at the feeding arm, and an interlocking gear which comes into engagement with each of the first gear and the second gear, wherein the gear train transfers the rotation to the feeding arm from the feeding tray so as to move the sheet feeding roller to the sheet feeding position in association with opening of the feed tray and to move the sheet feeding roller to the standby position in association with closure of the feed tray.

7. An apparatus according to claim 6, wherein said interlocking gear is one gear which comes into engagement with both of the first gear and the second gear.

8. An apparatus according to claim 6, wherein the interlocking gear is a multiple gear having a first gear portion which comes into engagement with the first gear and a second gear portion which comes into engagement with the second gear.

9. An apparatus according to claim 6, wherein the interlocking gear is a gear constructed in such a manner that a first gear member having a first gear portion which comes into engagement with the first gear and a second gear member having a second gear portion which comes into engagement with the second gear are coaxially provided and the first gear member and the second gear member rotate.

10. An apparatus according to claim 6, wherein the first gear is attached to the rotary axis of the hinge member in association with the opening/closure of the feed tray.

* * * * *